US011958716B2

(12) United States Patent
Li

(10) Patent No.: US 11,958,716 B2
(45) Date of Patent: Apr. 16, 2024

(54) ROPE ADJUSTOR AND WEARABLE ITEM

(71) Applicant: Huiqing Li, Shenzhen (CN)

(72) Inventor: Huiqing Li, Shenzhen (CN)

( * ) Notice: Subject to any disclaimer, the term of this patent is extended or adjusted under 35 U.S.C. 154(b) by 0 days.

(21) Appl. No.: 18/326,308

(22) Filed: May 31, 2023

(65) Prior Publication Data

US 2023/0382678 A1 Nov. 30, 2023

(30) Foreign Application Priority Data

May 31, 2022 (CN) ..... 202210607125.5
Mar. 30, 2023 (CN) ..... 202320742873.4
Mar. 30, 2023 (CN) ..... 202320751124.8

(51) Int. Cl.
*A43C 11/16* (2006.01)
*B65H 75/30* (2006.01)

(52) U.S. Cl.
CPC ..... *B65H 75/30* (2013.01); *A43C 11/165* (2013.01); *B65H 2701/35* (2013.01)

(58) Field of Classification Search
CPC .... B65H 75/30; B65H 2701/35; A43C 11/165
See application file for complete search history.

(56) References Cited

U.S. PATENT DOCUMENTS 7,575,224 B1 8/2009 Madland
2015/0191326 A1* 7/2015 Hall ..... B65H 75/4431 242/396.4
2017/0042289 A1* 2/2017 Ha ..... A44B 99/00
2020/0346888 A1* 11/2020 Kruse ..... A43B 23/0205
2021/0127794 A1* 5/2021 Chen ..... A43C 11/06
2021/0127795 A1* 5/2021 Chen ..... A43C 11/06
2021/0269275 A1* 9/2021 Kim ..... B65H 54/02
(Continued)

FOREIGN PATENT DOCUMENTS

CN 107247335 A 10/2017
CN 210382859 U 4/2020
CN 210747574 U 6/2020
(Continued)

OTHER PUBLICATIONS

International Search Report dated Dec. 19, 2022, in corresponding International Application No. PCT/CN2022/105601, 8 pages.

*Primary Examiner* — Sang K Kim
(74) *Attorney, Agent, or Firm* — Jeenam Park

(57) ABSTRACT

A rope adjustor and a wearable item. The rope adjustor includes a base, a rope reel, a first linkage portion is arranged on the rope reel; a rotation-stopping tray, the rotation-stopping tray is arranged on and connected to the base, and the rope reel is arranged inside the rotation-stopping tray, a first rotation-stopping portion is arranged on one side of the rotation-stopping tray away from the base; and a rotatable cover, the rotatable cover is arranged on and rotationally connected to the rotation-stopping tray, and the rotatable cover is insertably connected to the rope reel, and one side of the rotatable cover facing the rotation-stopping tray is provided with a second linkage portion and a second rotation-stopping portion, the first linkage portion is cooperated with the second linkage portion, and the first rotation-stopping portion is cooperated with the second rotation-stopping portion.

15 Claims, 12 Drawing Sheets

(56) References Cited

U.S. PATENT DOCUMENTS

| | | | | |
|---|---|---|---|---|
| 2021/0284483 | A1* | 9/2021 | Chen | A43C 11/165 |
| 2021/0289889 | A1* | 9/2021 | Chen | B65H 75/48 |

FOREIGN PATENT DOCUMENTS

| | | | |
|---|---|---|---|
| CN | 114291666 | A | 4/2022 |
| CN | 114304811 | A | 4/2022 |
| JP | 2022019790 | A | 1/2022 |

* cited by examiner

ROPE ADJUSTOR AND WEARABLE ITEM

CROSS-REFERENCE TO RELATED APPLICATIONS

This application claims priority to Chinese patent application No. 2022106071255, filed on May 31, 2022, Chinese patent application No. 2023207428734 filed on Mar. 30, 2023, and Chinese patent application No. 2023207511248 filed on Mar. 30, 2023, the content of all of which is incorporated herein by reference.

TECHNICAL FIELD

The present disclosure relates to the technical field of regulating tightness of ropes, in particular to a rope adjustor and a wearable item.

BACKGROUND

In daily life, there are some items tied with ropes, such as shoes, belts, small bags, etc. When in use, the rope is adjusted to achieve the purpose of tightening or loosening the rope. In order to facilitate easy and fast adjustment of the rope, rope adjustors have emerged. However, in the prior art, the rope adjustors require many components to be assembled, resulting in a complex assembly process, and after the assembly is completed, misoperation is easy to occur during use.

SUMMARY

The object of the present disclosure is to provide a rope adjustor and a wearable item, to solve the technical problem that, in the prior art, the rope adjustors require many components to be assembled, resulting in a complex assembly process, and after the assembly is completed, misoperation is easy to occur during use.

In order to achieve the above-mentioned object, the technical solutions adopted in the present disclosure are as follows:

In a first aspect, the present disclosure provides a rope adjustor, which comprises:

a base;

a rope reel, a first linkage portion is arranged on the rope reel;

a rotation-stopping tray, the rotation-stopping tray is arranged on and connected to the base, and the rope reel is arranged inside the rotation-stopping tray, and a first rotation-stopping portion is arranged on one side of the rotation-stopping tray away from the base; and a rotatable cover, the rotatable cover is arranged on and rotationally connected to the rotation-stopping tray, and the rotatable cover is insertably connected to the rope reel, and one side of the rotatable cover facing the rotation-stopping tray is provided with a second linkage portion and a second rotation-stopping portion, the first linkage portion is cooperated with the second linkage portion, and the first rotation-stopping portion is cooperated with the second rotation-stopping portion.

According to the above-mentioned rope adjustor, the first linkage portion comprises a plurality of first linkage teeth, and the plurality of first linkage teeth are set with intervals and form a circle;

the second linkage portion comprises a plurality of second linkage teeth, and the plurality of second linkage teeth are set with intervals and form a circle;

the plurality of first linkage teeth and the plurality of second linkage teeth are intermeshed.

According to the above-mentioned rope adjustor, the first rotation-stopping portion comprises at least one rotation-stopping arm, and one end of the rotation-stopping arm is connected to the rotation-stopping tray, and another end of the rotation-stopping arm is a free end, and at least one first rotation-stopping tooth is arranged on the rotation-stopping arm;

the second rotation-stopping portion comprises a plurality of second rotation-stopping teeth, and the plurality of second rotation-stopping teeth are set with intervals and form a circle, and the first rotation-stopping tooth and the second rotation-stopping tooth are intermeshed.

According to the above-mentioned rope adjustor, a through cavity is arranged on the rotation-stopping tray, and the rope reel is set in the through cavity and is limited through the through cavity, an inserting-and-connecting hole is arranged on the rope reel, and one side of the rotatable cover facing the rotation-stopping tray is provided with an inserting-and-connecting column, and the inserting-and-connecting column is fixedly connected to the rotatable cover, and the inserting-and-connecting column is insertably connected to the inserting-and-connecting hole through the through cavity.

According to the above-mentioned rope adjustor, the inserting-and-connecting column comprises, a first connecting column, a free end of the first connecting column away from the rotatable cover is provided with a first limit convex portion that protrudes outwards; and a second connecting column, a free end of the second connecting column away from the rotatable cover is provided with a second limit convex portion that protrudes outwards;

the first connecting column and the second connecting column are set with intervals;

an inner part of the inserting-and-connecting hole is provided with a limit concave portion that concaves inwards, and both the first limit convex portion and the second limit convex portion are cooperated with the limit concave portion for a limit.

According to the above-mentioned rope adjustor, the base comprises a first connecting tray, and an edge of the first connecting tray is provided with a first connecting hole;

or the base comprises a second connecting tray, and an edge of the second connecting tray is provided with a second connecting hole, and a gap is arranged on the second connecting tray.

In a second aspect, the present disclosure also provides a wearable item, which comprises the above-mentioned rope adjustor.

BRIEF DESCRIPTION OF THE DRAWINGS

In order to more clearly explain the technical solutions in the embodiments of the present disclosure, the accompanying drawings required in the embodiments of the present disclosure or the descriptions of the prior art are briefly introduced below. Obviously, the accompanying drawings introduced below are only some embodiments of the present disclosure. For those skilled in the art, other accompanying drawings can be obtained based on the present accompanying drawings without any creative work.

DETAILED DESCRIPTION OF EMBODIMENTS

In order to make the technical problems to be solved, the technical solutions and the beneficial effects of the present disclosure clearer and more definite, the present disclosure is further described in detail below in conjunction with the accompanying drawings and the embodiments. It should be understood that the specific embodiments described here are only used to explain the present disclosure, not to limit the present disclosure.

Embodiment 1

Figure 1:
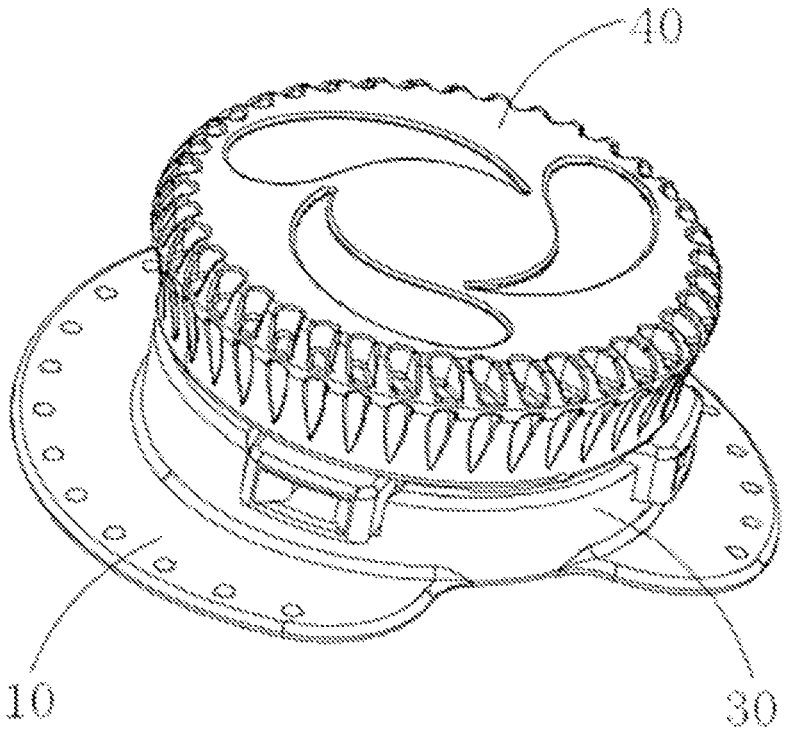
FIG. 1 is a schematic diagram of a rope adjustor provided in a first embodiment of the present disclosure.
Figure 2:
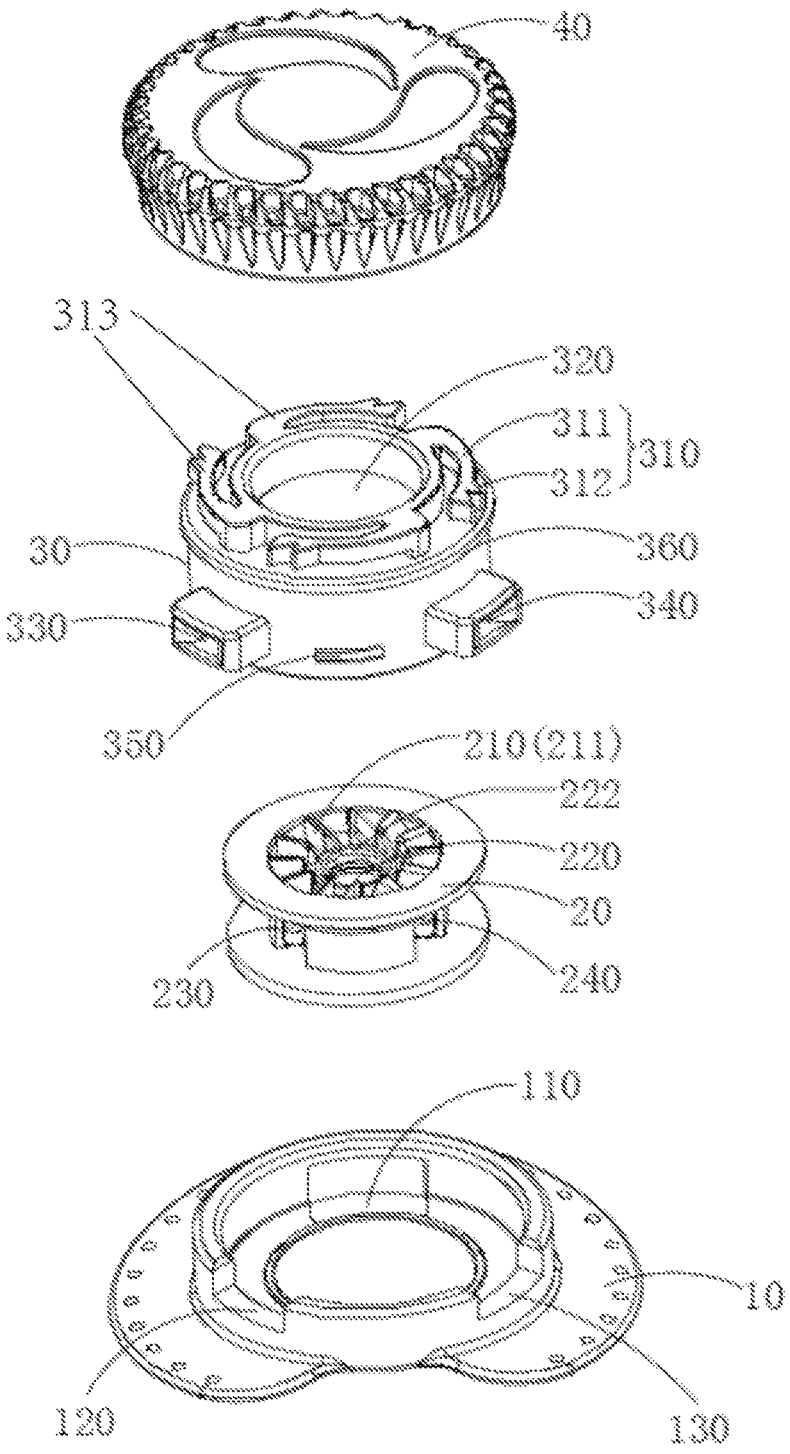
FIG. 2 is a first exploded schematic diagram of the rope adjustor provided in the first embodiment of the present disclosure.
Figure 3:
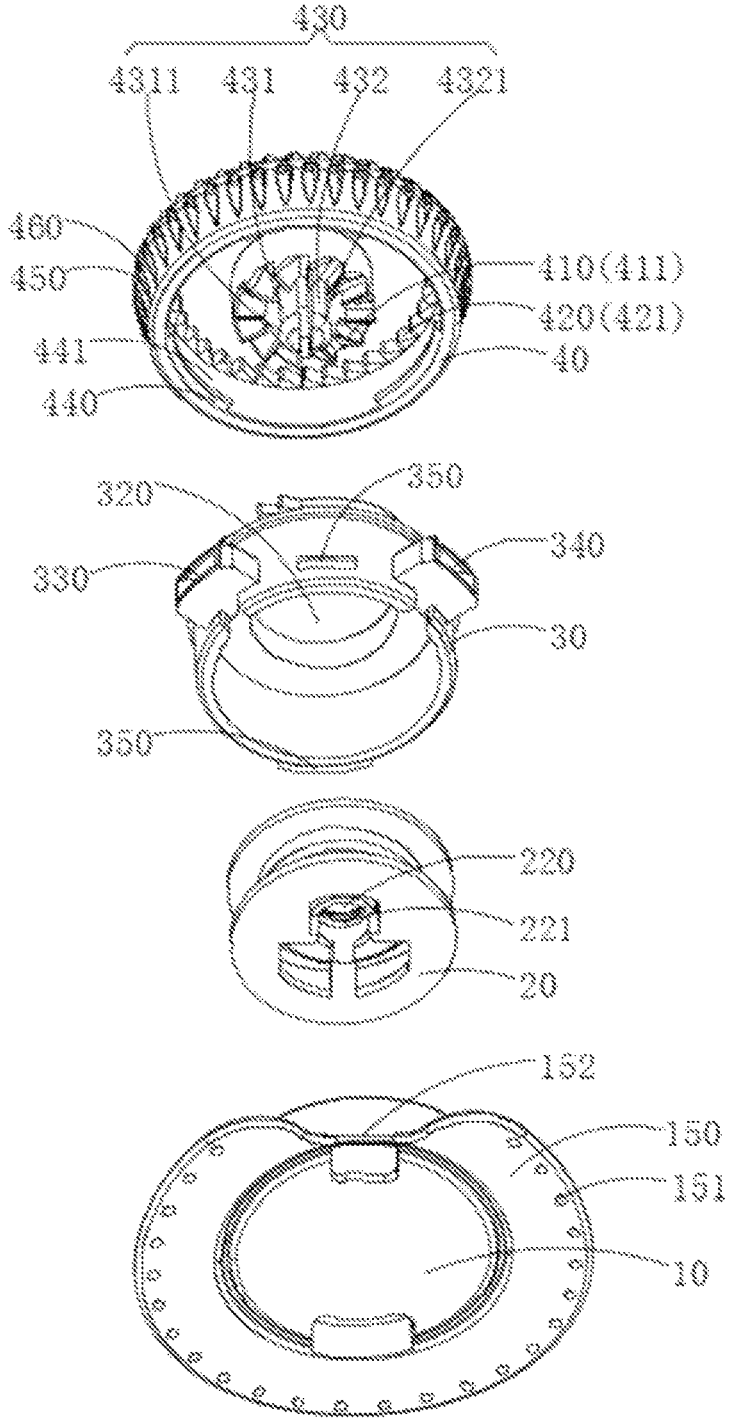
FIG. 3 is a second exploded schematic diagram of the rope adjustor provided in the first embodiment of the present disclosure.

Please refer to FIGS. 1 to 3, the present embodiment provides a rope adjustor, which comprises a base 10, a rope reel 20, a rotation-stopping tray 30 and a rotatable cover 40. A first linkage portion 210 is provided on the rope reel 20; the rotation-stopping tray 30 is provided on the base 10 and connected to the base 10, and the rope reel 20 is provided inside the rotation-stopping tray 30. One side of the rotation-stopping tray 30 away from the base 10 is provided with a first rotation-stopping portion 310. The rotatable cover 40 is set on the rotation-stopping tray 30 and is rotatably connected to the rotation-stopping tray 30, and the rotatable cover 40 is insertably connected to the rope reel 20. One side of the rotatable cover 40 facing the rotation-stopping tray 30 is provided with a second linkage portion 410 and a second rotation-stopping portion 420, the first linkage portion 210 and the second linkage portion 410 are in a cooperation, and the first rotation-stopping portion 310 and the second rotation-stopping portion 420 are in a cooperation.

A working principle of the rope adjustor provided in the present embodiment is as follows: when assembling the rope adjustor, an assembly process is that firstly placing the rope reel 20 inside the rotation-stopping tray 30; then placing the rotation-stopping tray 30 placed with the rope reel 20 on the base 10, and connecting the rotation-stopping tray 30 with the base 10; finally placing the rotatable cover 40 on the rotation-stopping tray 30, and connecting the rotatable cover 40 with the rotation-stopping tray 30 and the rope reel 20 inside the rotation-stopping tray 30. After assembly, mounting the whole rope adjustor on shoes, belts, or small bags etc. through the base 10. It should be understood that after assembly, the first linkage portion 210 and the second linkage portion 410 are in a cooperation state, the first rotation-stopping portion 310 and the second rotation-stopping portion 420 are in a fit cooperation state, and the rotatable cover 40 is inserted into the rope reel 20. During process of tightening the rope, there is a continual "Da Da" sound when rotating the rotatable cover 40 continually, and users have a strong sense of participation and interaction.

When it is necessary to tighten the rope, rotating the rotatable cover 40 directly in a direction of tightening the rope (such as a clockwise direction). Due to the cooperation between the second linkage portion 410 on the rotatable cover 40 and the first linkage portion 210 on the rope reel 20, after rotating the rotatable cover 40, the rotatable cover drives the rope reel 20 to rotate, so as to make the rope reel 20 to rotate relative to the rotation-stopping tray 30, achieving tightening the rope. At the same time, due to the cooperation between the first rotation-stopping portion 310 and the second rotation-stopping portion 420, it is possible to limit the rope tightened to an appropriate position. When loosening the rope, there is a "Pa" sound when successfully pulling out or pressing the rotatable cover 40, and users have a strong sense of participation and interaction.

When it is necessary to loosen the rope, firstly pulling the rotatable cover 40 upwards, i.e. pulling the rotatable cover 40 out of the rope reel 20; then directly pulling the rope that threads through wearable item to make the rope reel 20 rotate relative to the rotation-stopping tray 30, so as to achieve loosening the rope. After loosening the rope to an appropriate position, then applying downward force to press the rotatable cover 40 to make the rotatable cover 40 be inserted into the rope reel 20, so as to make the first linkage portion 210 and the second linkage portion 410 be in the cooperation state, and the first rotation-stopping portion 310 and the second rotation-stopping portion 420 are in the cooperation state, achieving limiting the rope loosened to the appropriate position.

The beneficial effects of the rope adjustor provided by the present embodiment are at least as follows:

(1). The rope adjustor provided in the present embodiment, requires few components to be assembled, and an assembly process is simple, and the components to be assembled are fastened from top to bottom, reducing error probability in production and use. Due to the few components to be assembled, production efficiency is improved, production costs are reduced, equipment for producing each component is simple, and total quantity of production equipment is also reduced.

(2). The rope adjustor provided in the present embodiment, wherein when it is necessary to tighten the rope, users only need to rotate the rotatable cover 40 so as to tighten the rope and limit the tightened rope, thereby achieving a simple operation process. When it is necessary to loosen the rope, users only need to pull out the rotatable cover 40 and then loosen the rope, and after the rope is loosened to an appropriate position, users press the rotatable cover 40 to an original position to limit the loosened rope, thus reducing misoperation that causes the rope to be loose during normal use.

(3). The rope adjustor provided in the present embodiment, wherein when tightening the rope, there is a continual "Da Da" sound when rotating the rotatable cover 40 continually; when loosening the rope, there is a "Pa" sound when successfully pulling out or pressing the rotatable cover. In the process of tightening the rope or loosening the rope, users have a strong sense of participation and interaction, improving users' experience.

In one embodiment, please refer to FIGS. 2 and 3, the first linkage portion 210 comprises a plurality of first linkage teeth 211, and the plurality of first linkage teeth 211 are set with intervals and placed in a circular shape; the second linkage portion 410 comprises a plurality of second linkage teeth 411, and the plurality of second linkage teeth 411 are set with intervals and placed in a circle shape; the plurality of first linkage teeth 211 and the plurality of second linkage teeth 411 are intermeshed. By intermeshing the plurality of first linkage teeth 211 with the plurality of second linkage teeth 411, when it is necessary to tighten the rope, directly rotating the rotatable cover 40 can drive the rope reel 20 to rotate, so as to tighten the rope, and achieve simple and stable linkage structure. In one embodiment, please continue to refer to FIGS. 2 and 3. The first rotation-stopping portion 310 comprises at least one rotation-stopping arm 311, one end of the rotation-stopping arm 311 is connected to the rotation-stopping tray 30, another end of the rotation-stopping arm 311 is a free end, and at least one first rotation-stopping tooth 312 is provided on the rotation-stopping arm 311; the second rotation-stopping portion 420 comprises a plurality of second rotation-stopping teeth 421, and the plurality of second rotation-stopping teeth 421 are set with intervals and placed in a circle shape. The first rotation-stopping tooth 312 and the second rotation-stopping tooth 421 are intermeshed.

When it is necessary to limit the tightened rope, during a process of rotating the rotatable cover 40, the second rotation-stopping tooth 421 on the rotatable cover 40 is engaged with the first rotation-stopping tooth 312 on the free end of the rotation-stopping arm 311 one by one, i.e. each state of the tightened rope can be limited, and a "Ka Ta" sound is emitted during the rotating process to remind users to stop rotating the rotatable cover 40 when the rope is regulated to an appropriate position, so as to achieve tightening the rope to an appropriate state for limiting the tightened rope. When it is necessary to limit the loosened rope, during a process of loosening the rope, the rotatable cover 40 is in an upward-pulling state, and the first rotation-stopping tooth 312 and the second rotation-stopping tooth 421 do not engage with each other; when the rope is regulated to an appropriate state, pressing the rotatable cover 40 downwards to make the first rotation-stopping tooth 312 be engaged with the second rotation-stopping tooth 421, thus achieving limiting the rope loosened to an appropriate state. The first rotation-stopping portion 310 and the second rotation-stopping portion 420 provided above both have a simple structure and can achieve a stable limit for the rope with different tightness.

It should be understood that in the present embodiment, tightening the rope and limiting the tightened rope are achieved by rotating the rotatable cover 40 in the clockwise direction. When changing a setting direction of the rotation-stopping arm 311, it is possible to rotate the rotatable cover 40 in a counterclockwise direction to tighten the rope and the tightened rope.

In one embodiment, the first rotation-stopping portion 310 comprises a plurality of rotation-stopping arms 311, and the plurality of rotation-stopping arms 311 are set with intervals. A plurality of first rotation-stopping teeth 312 are set on each rotation-stopping arm 311, and the plurality of first rotation-stopping teeth 312 are set with intervals.

In one embodiment, the first rotation-stopping portion 310 comprises 4 rotation-stopping arms 311, and the 4 rotation-stopping arms 311 are set with intervals. 2 or 3 first rotation-stopping teeth 312 are set on each rotation-stopping arm 311.

It should be understood that a quantity and an arrangement way of the rotation-stopping arm 311 and the first rotation-stopping tooth 312 are not limited to the above embodiments, but can also be other embodiments, and there are no limits here.

In one embodiment, please continue to refer to FIGS. 2 and 3, a through cavity 320 is set on the rotation-stopping tray 30, the rope reel 20 is set in the through cavity and is to limit position through the through cavity; an inserting-and-connecting hole 220 is set on the rope reel 20, and one side of the rotatable cover 40 facing the rotation-stopping tray 30 is provided with an inserting-and-connecting column 430, the inserting-and-connecting column 430 is fixedly connected to the rotatable cover 40, and the inserting-and-connecting column 430 is insertably connected to the inserting-and-connecting hole 220 through the through cavity 320.

The rotatable cover 40 and the rope reel 20 are insertably connected through a cooperation between the inserting-and-connecting column 430 and the inserting-and-connecting hole 220, achieving an upward limit and a downward limit for the rotatable cover 40, and a simple connection structure, a convenient assembly process, and a convenient operation. Setting the through cavity 320 not only stably fixes the rope reel 20 in the rotation-stopping tray 30 and stably limits the rope reel 20, but also facilitates the cooperation between the inserting-and-connecting column 430 and the inserting-and-connecting hole 220.

In one embodiment, the inserting-and-connecting column 430 is set on a middle part of the rotatable cover 40, the second linkage portion 410 is set on a periphery of the inserting-and-connecting column 430, and the second rotation-stopping portion 420 is set on a periphery of the second linkage portion 410; the inserting-and-connecting hole 220 is set on a middle part of the rope reel 20, the first linkage portion 210 is set on a periphery of the inserting-and-connecting hole 220 and encloses the inserting-and-connecting hole 220, and the first rotation-stopping portion 310 is set at an edge of the rotation-stopping tray 30 and on a periphery of the first linkage portion 210.

In one embodiment, please continue to refer to FIGS. 2 and 3, the first inserting-and-connecting column 430 comprises a first connecting column 431 and a second connecting column 432, wherein a free end of the first connecting column 431 away from the rotatable cover 40 is provided with a first limit convex portion 4311 that protrudes outwards; a free end of the second connecting column 432 away from the rotatable cover 40 is provided with a second limit convex portion 4321 that protrudes outwards; the first connecting column 431 and the second connecting column 432 are set with intervals. A limit concave portion 221 that is inwards concave is set inside the inserting-and-connecting hole 220, and both the first limit convex portion 4311 and the second limit convex portion 4321 are cooperated with the limit concave portion 221 for limiting.

During a process of inserting the inserting-and-connecting column 430 into the inserting-and-connecting hole 220, both the free end of the first connecting column 431 and the free end of the second connecting column 432 are pressed towards a space between the first connecting column 431 and the second connecting column 432, and then both the first connecting column 431 and the second connecting column 432 are inserted into the inserting-and-connecting hole 220, and at this time, the first limit convex portion 4311 that protrudes outwards on the first connecting column 431 and the second limit convex portion 4321 that protrudes outwards on the second connecting column 432 both cooperate with the limit concave portion 221 to achieve a limit and a fitting snap for the inserting-and-connecting column 430 inserted into the inserting-and-connecting hole 220. During a process of inserting both the first connecting column 431 and the second connecting column 432 into the inserting-and-connecting hole 220, there is a "Pa" sound. When the inserting-and-connecting column 430 is pulled out from the inserting-and-connecting hole 220, i.e. when applying force to pull the rotatable cover 40 upwards, the free end of the first connecting column 431 and the free end of the second connecting column 432 are both pressed towards the space between the first connecting column 431 and the second connecting column 432, and then the first connecting column 431 and the second connecting column 432 are both pulled out from the inserting-and-connecting hole 220. A cooperation structure of the inserting-and-connecting column 430 and the inserting-and-connecting hole 220 provided in the present embodiment is a subtle design, and a simple and stable structure, and an operation is convenient and fast. During a process of pulling out the first connecting column 431 and the second connecting column 432 from the inserting-and-connecting hole 220, there is also a "Pa" sound.

In one embodiment, a concave edge in a top of the inserting-and-connecting hole 220 is provided with a concave portion 222. When the inserting-and-connecting column 430 is pulled out from the inserting-and-connecting hole 220, the first limit convex portion 4311 and the second limit convex portion 4321 are both located inside the concave portion 222.

In one embodiment, a cross-sectional shape of the first limit convex portion 4311, the second limit convex portion 4321 and the limit concave portion 221 forms a right triangle. Either right-angled side of the right triangle is for guiding force avoiding a secure connection, and the hypotenuse of the right triangle is for automatically guiding to a position when pressing.

It should be understood that the inserting-and-connecting column 430 is not limited to comprising the first connecting column 431 and the second connecting column 432 mentioned above, but can also comprise other quantities of connecting columns, such as three or more connecting columns, without limitation here.

In one embodiment, please continue to refer to FIGS. 2 and 3. One or more threading portions are set on the rotation-stopping tray 30, such as a first threading portion 330 and a second threading portion 340. A first threading hole 230 and a second threading hole 240 are set on the rope reel 20. One end of the rope sequentially threads through the first threading portion 330 and the first threading hole 230 and fixed at the first threading hole 230, and another end of the rope sequentially threads through the second threading portion 340 and the second threading hole 240, and is fixed at the second threading hole 240.

In practical applications, an assembly process of the rope and the rope adjustor is that when the rope threads back and forth through wearable item (such as shoes, waistband, or small bag), one end of the rope sequentially threads through the first threading portion 330 and the first threading hole 230, and is tied and fixed at the first threading hole 230. Another end of the rope sequentially threads through the second threading portion 340, the second threading hole 240, and is tied and fixed at the second threading hole 240, achieving assembling the rope on the rope adjustor.

In one embodiment, please continue to refer to FIGS. 2 and 3, at least one snap-fitting piece 350 is set on the rotation-stopping tray 30, at least one snap-fitting position 110 is set on the base 10, and the snap-fitting piece 350 is connected to the snap-fitting position 110 in a fitting snap; a first limit notch 120 and a second limit notch 130 are set on the base 10, the first threading portion 330 is located inside the first limit notch 120 and is limited through the first limit notch 120, the second threading portion 340 is located inside the second limit notch 130 and is limited through the second limit notch 130.

The first threading portion 330 is set and located in the first limit notch 120, and the second threading portion 340 is set and located in the second limit notch 130, achieving limiting the rotation-stopping tray 30 and facilitating extending the rope out from the rope adjustor. The snap-fitting piece 350 and the snap-fitting position 110 cooperate with each other, achieving a stable connection of the rotation-stopping tray 30 on the base 10, wherein the connection structure is simple and secure.

In one embodiment, two snap-fitting pieces 350 are set on the rotation-stopping tray 30, and two snap-fitting positions 110 are set on the base 10, wherein such a setting can make the rotation-stopping tray 30 be more stably connected on the base 10. It should be understood that a setting quantity of the snap-fitting piece 350 and the snap-fitting position 110 is not limited to the present embodiment, but can also be other embodiments, and there is no limit here.

Figure 4:
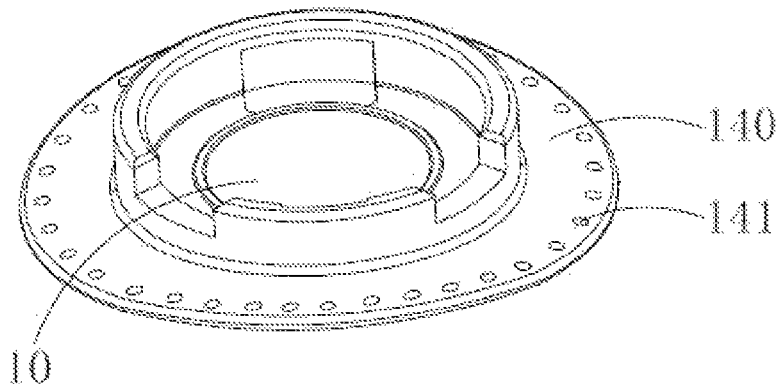
FIG. 4 is a schematic diagram of a base provided in the first embodiment of the present disclosure.

In one embodiment, please refer to FIG. 4, the base 10 comprises a first connecting tray 140, an edge of the first connecting tray 140 is provided with a first connecting hole 141. The first connecting hole 141 is provided to facilitate fixing the whole rope adjustor on wearable item stably.

In one embodiment, the first connecting tray 140 is in an arch shape to facilitate mounting the first connecting tray 140 on wearable item (such as shoes) and then fitting the first connecting tray 140 and upper of the shoes together.

In one embodiment, the first connecting tray 140 is in a flat shape to facilitate mounting the first connecting tray 140 on a box that has flat surface and fitting the first connecting tray 140 and the flat surface of the box together.

In one embodiment, please refer to FIG. 3, the base 10 comprises a second connecting tray 150, an edge of the second connecting tray 150 is provided with a second connecting hole 151, and a gap 152 is set on the second connecting tray 150. The second connecting hole 151 facilitates stably fixing the whole rope adjustor on wearable item. A setting of the gap 152 can make the rope adjustor closer to vamp without interfering foot, and is not easy to hurt foot. Moreover, the setting of the gap is convenient for disassembly, and by pushing a disassembly rod in a designated direction, disassembly can be achieved, making maintenance convenient.

In one embodiment, the second connecting tray 150 is in an arch shape to facilitate mounting the second connecting tray 150 on wearable item (such as shoes) and then fitting the second connecting tray 150 and upper of the shoes together.

In one embodiment, the second connecting tray 150 is in a flat shape, which facilitates being installed on a box that has flat surface and then fitting the second connecting tray 150 and the flat surface of the box together.

In one embodiment, please continue to refer to FIGS. 2 and 3, an outer side wall of the rotation-stopping tray 30 is provided with an annular limit lug 360, and an inner side wall of the rotatable cover 40 is provided with at least one limit bump 440; the limit bump 440 and a top of the rotatable cover 40 form a limit groove 441, and the rotatable cover 40 is set outside the rotation-stopping tray 30, and the annular limit lug 360 is located inside the limit groove 441 and is limited through a cooperation of the annular limit lug 360 and the limit groove 441, and the rotatable cover 40 can move upwards and downwards relative to the rotation-stopping tray 30.

The cooperation of the limit groove 441 and the annular limit lug 360 achieves limiting and connecting the rotatable cover 40 on the rotation-stopping tray 30, and the rotatable cover 40 can rotate relative to the rotation-stopping tray 30, and the rotatable cover 40 can move upwards and downwards relative to the rotation-stopping tray 30. When loosening the rope, after pulling upwards the rotatable cover 40, the limit groove 441 and the annular limit lug 360 are cooperated to limit the rotatable cover 40 pulled upwards and prevent the rotatable cover 40 from completely separating from the rotation-stopping tray 30.

In one embodiment, an outer wall of the rotatable cover 40 is provided with a plurality of anti-slip concave portions 450, and the plurality of anti-slip concave portions 450 are set with intervals; correspondingly, an anti-slip convex portion 460 is formed between any two adjacent anti-slip concave portions 450, such a setting can provide an anti-slip effect when rotating the rotatable cover 40.

Figure 11:
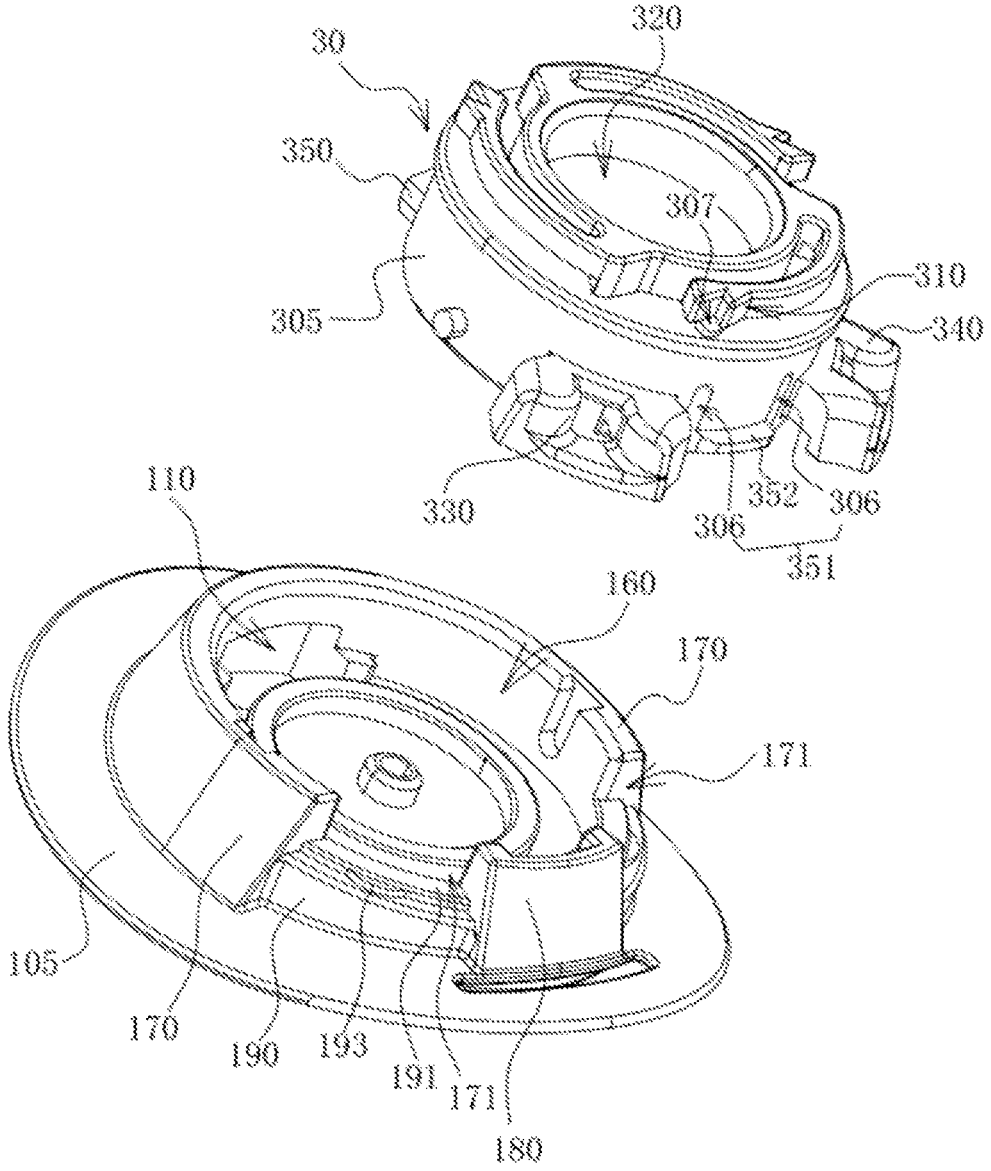
FIG. 11 is an exploded view of the base and the rotation-stopping tray of the rope adjustor provided in the third embodiment of the present disclosure.
Figure 13:
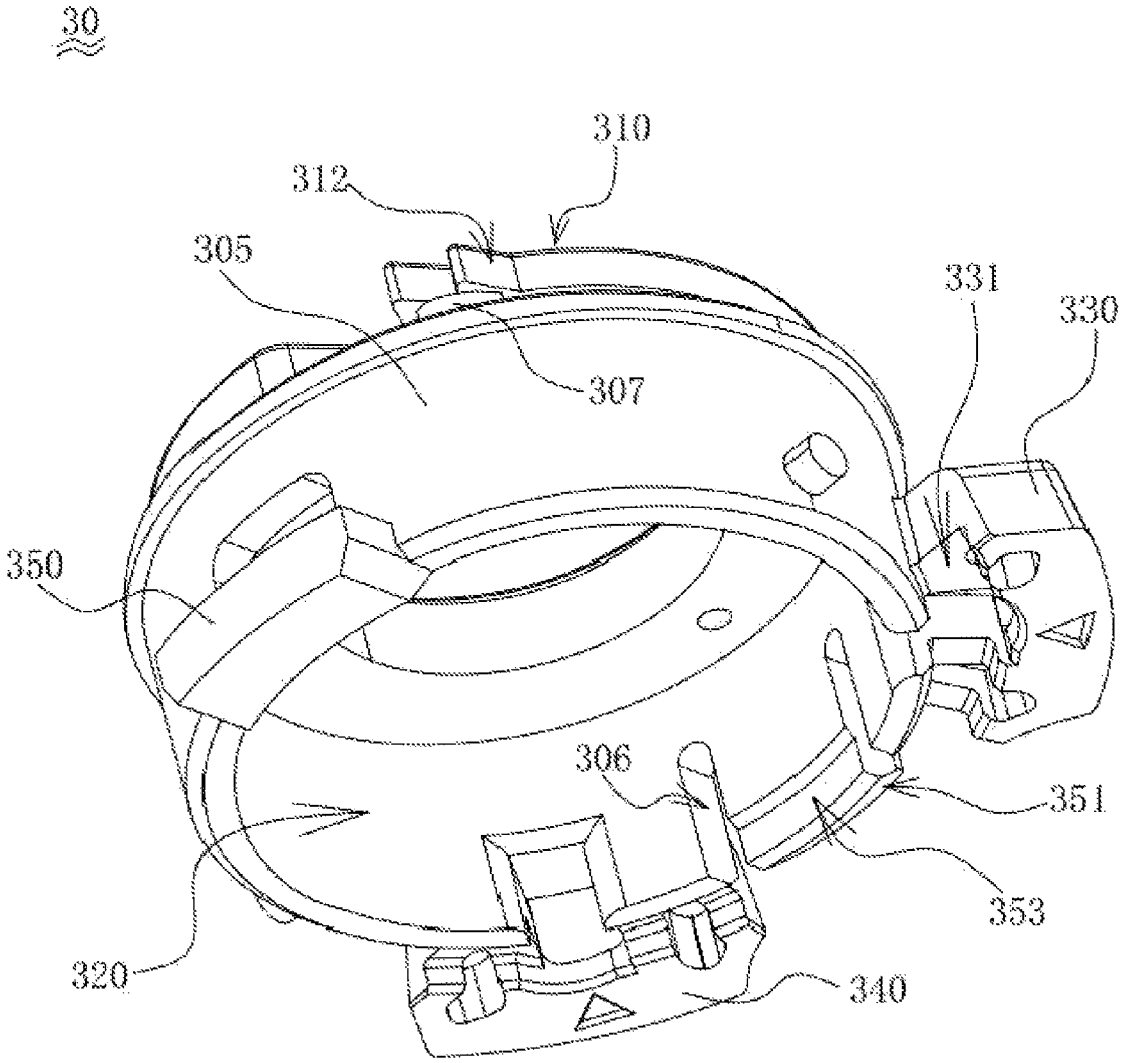
FIG. 13 is a schematic diagram of the rotation-stopping tray of the rope adjustor provided in the third embodiment of the present disclosure.
Figure 14:
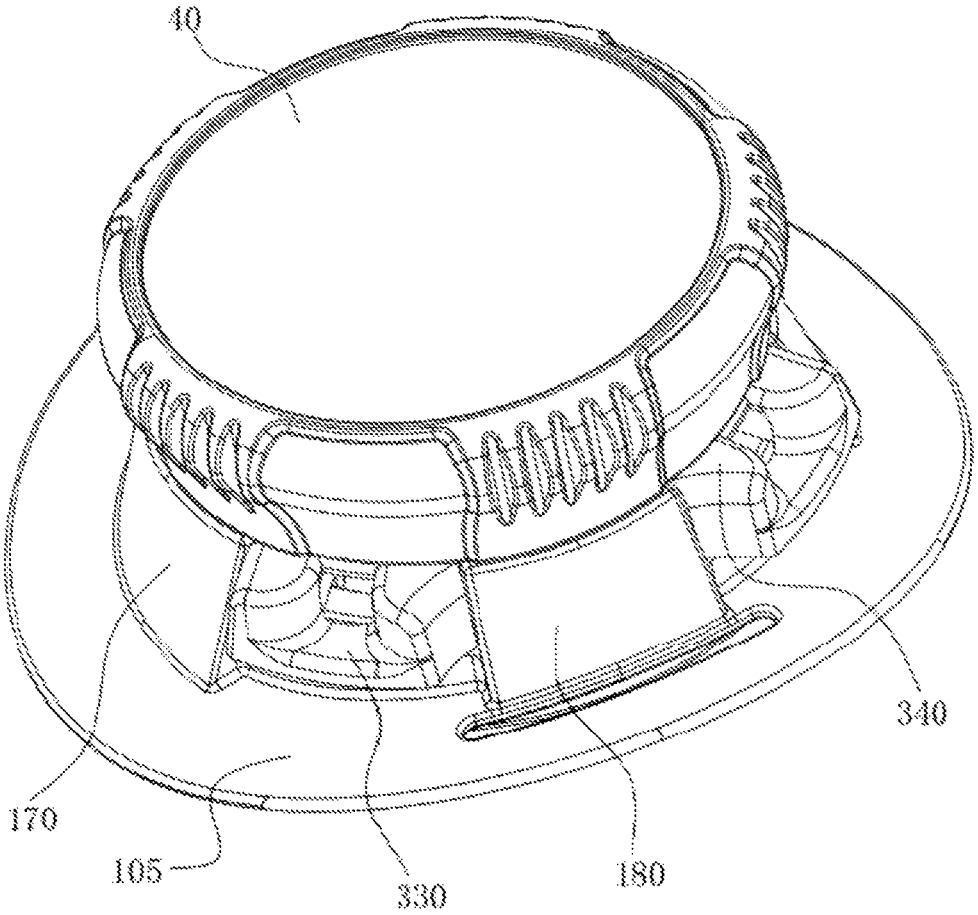
FIG. 14 is a schematic diagram of the rope adjustor provided in the third embodiment of the present disclosure.

As shown in FIGS. 2, 11, and 13, further, there is a space between the first rotation-stopping portion 310 and an upper surface of a tray body 305 of the rotation-stopping tray 30. The upper surface of the tray body 305 is provided with an abutment boss 307 (as shown in FIG. 4), and the abutment boss 307 is corresponded to a movable end (free end). The upper surface of the tray body 305 supports a lower part of the first rotation-stopping portion 310, so that when the first rotation-stopping portion 310 limits the second rotation-stopping portion 420, when a reeling force of the rope reel 20 is relatively high, a pressing force of the second rotation-stopping portion 420 on the first rotation-stopping portion 310 also increases; and during a process of the first rotation-stopping portion 310 being pressed, the first rotation-stopping portion 310 is easy to deform; at this time, the first rotation-stopping portion 310 is abutted by the abutment boss 307 on the upper surface of the tray body 305, so as to avoid the deformation of the first rotation-stopping portion 310 downwards causing setting aside a space; and if setting aside the space occurs, the second rotation-stopping portion 420 will separate from the first rotation-stopping portion 310, resulting in a failure of a unidirectional rotational function. The first rotation-stopping portion 310 is stably supported by the abutment boss 307, which can avoid the failure of the unidirectional rotational function and improve structural stability.

Embodiment 2

Figure 5:
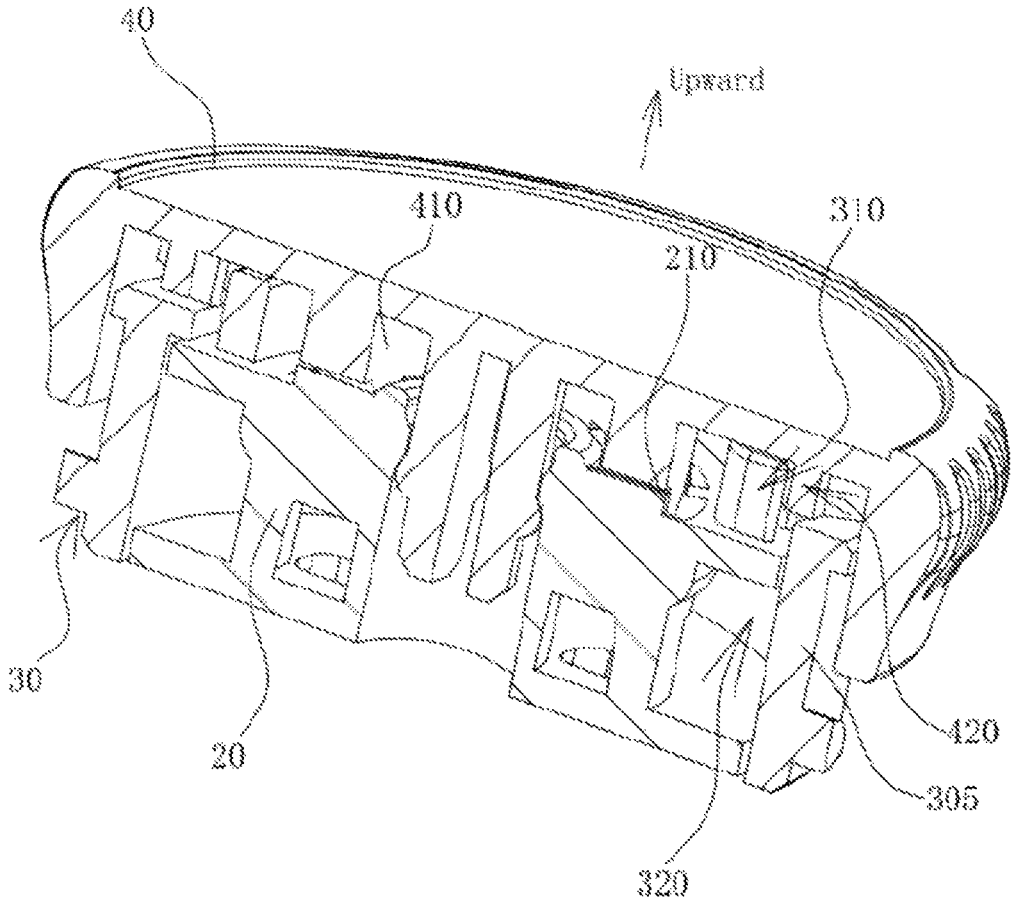
FIG. 5 is a cross-sectional view of a rotation-stopping tray, a rope reel and a rotatable cover of a rope adjustor provided in a second embodiment of the present disclosure.
Figure 7:
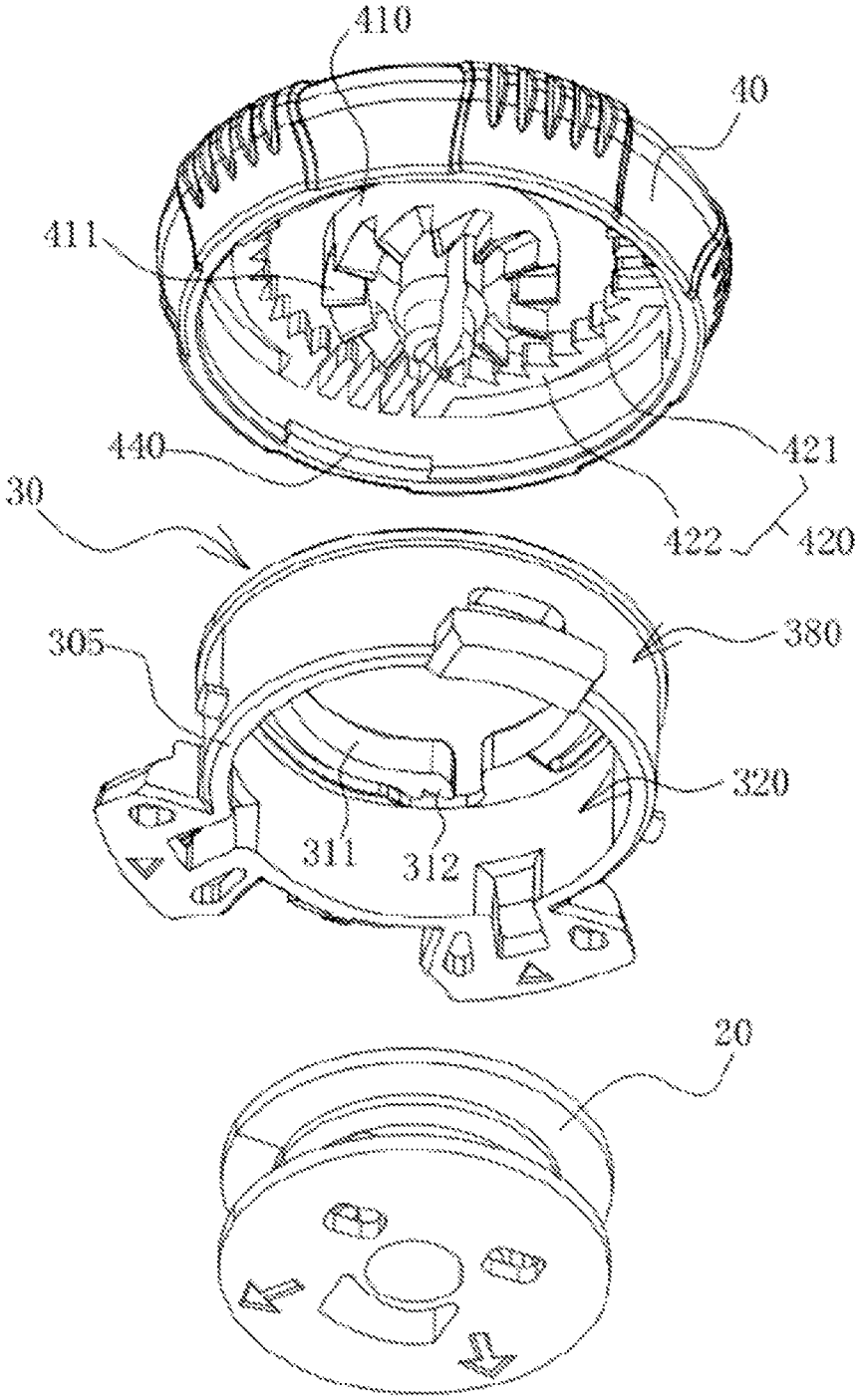
FIG. 7 is an exploded view of the rotation-stopping tray, the rope reel and the rotatable cover of the rope adjustor provided in the second embodiment of the present disclosure in another perspective.

As shown in FIGS. 5, 4, and 7, the rope adjustor provided by the present embodiment, comprises a base 10, a rotation-stopping tray 30, a rope reel 20 located in the rotation-stopping tray 30, and a rotatable cover 40 that can be separated from the rope reel 20. When the rotatable cover 40 is pressed downwards, the rotatable cover 40 can be connected to the rope reel 20 and the rotation-stopping tray 30. By rotating the rotatable cover 40, the rope reel 20 is driven to rotate, and the rope reel 20 is connected with a rope that needs to be tightened, and by rotating the rope reel 20 to tighten the rope, a tightening function is achieved. To prevent loosening, the rotatable cover 40 is activated by the rotation-stopping tray 30 to make the rotatable cover 40 drive the rope reel 20 to only rotate unidirectionally in a reeling direction during a reeling process. When loosening the rope, pulling upwards the rotatable cover 40 can separate the rotatable cover 40 from the rotation-stopping tray 30; the rotation-stopping tray 30 releases a unidirectional limit to the rotatable cover 40, and both the rotatable cover 40 and the rope reel 20 can rotate in reserve to loosen the rope; by adopting such a structure, it is possible to quickly tie ropes, such as tying shoelaces etc. To achieve a unidirectional rotation function of the rotatable cover 40, a second rotation-stopping portion 420 is set inside the rotatable cover 40, and the rotation-stopping tray 30 mainly comprises a tray body 305 and a first rotation-stopping portion 310. For a convenience of structural description, the present rope adjustor is generally set to a circular shape, and the tray body 305 is also generally in a cylindrical structure; an up-to-down direction is an axial direction of the tray body 305, and a direction facing an axis of the tray body 305 is inward, and a direction deviating from the axis of the tray body 305 is outward. A through cavity 320 is provided in the tray body 305, and the rope reel 20 can be rotatably arranged in the through cavity 320. The rope reel 20 can be limited inside the through cavity 320 through the rotation-stopping tray 30. A rope-fixing perforation is provided on the rope reel 20, and the rope threads through a perforation on an outer wall of the tray body 305 and enters the through cavity 320, and is connected to the rope-fixing perforation on the rope reel 20, so as to achieve a tightening function when the rope reel 20 rotates in the rotation-stopping tray 30 in a unidirectional direction. One end of the first rotation-stopping portion 310 is connected to an inner wall of the through cavity 320, and another end of the first rotation-stopping portion 310 is movable located in the through cavity 320. The another end of the first rotation-stopping portion 310 is used to cooperate and connect with the second rotation-stopping portion 420, to make the rotatable cover 40 drive the rope reel 20 to rotate in a unidirectional direction. Thus, a part of the first rotation-stopping portion 310 can be located below an upper surface of the tray body 305, and another part of first rotation-stopping portion 310 can protrude from the upper surface of the tray body 305 and can connect with the second rotation-stopping portion 420 to prevent the second rotation-stopping portion 420 from reversely rotating.

When the rotatable cover 40 is in a connecting state with the rotation-stopping tray 30, and also in a connecting state with the rope reel 20, the first rotation-stopping portion 310 is in a connecting state with the second rotation-stopping portion 420 to prevent the second rotation-stopping portion 420 from reversely rotating, so that the rotatable cover 40 can only rotate in a forward direction and drive the rope reel 20 to rotate in a forward direction, so as to achieve a reeling function. When the rotatable cover 40 is not in the connecting state with the rotation-stopping tray 30, the first rotation-stopping portion 310 separates from the second rotation-stopping portion 420 and does not limit the second rotation-stopping portion 420, thus achieving a reverse rotation to loosen the rope. By setting the first rotation-stopping portion 310 in the through cavity 320, a part of the snap-fitting position 110 in an up-to-down direction can be located below the upper surface of the tray body 305, while another part protrudes from the upper surface of the tray body 305; compared to the prior art, under a condition that the first rotation-stopping portion 310 has a same structural strength, the present technical solution moves the whole first rotation-stopping portion 310 downwards, so as to reduce a thickness of the rotation-stopping tray 30 in the up-to-down direction, achieving a better application to products such as shoes etc., and avoiding surfaces of the product being too abrupt, making a use of the present rope adjustor more convenient, and improving an utility of the present rope adjustor. In addition, setting the first rotation-stopping portion 310 directly on an inner wall, avoids a need for arranging an additional outer wall on the tray body 305 for supporting in the prior art, so as to save materials, and at least save excess materials of structures with outer walls and reduce production costs during an injection molding process. In addition, during an injection molding process the rotation-stopping tray 30 is produced through injection molding with mold, which can easily achieve an up-to-down threading mode, and can improve a production capacity using single mold from an original maximum of 1:8 (8 products produced in one injection) to 1:32 (32 products produced in one injection), or even higher, thereby reducing injection costs.

Figure 6:
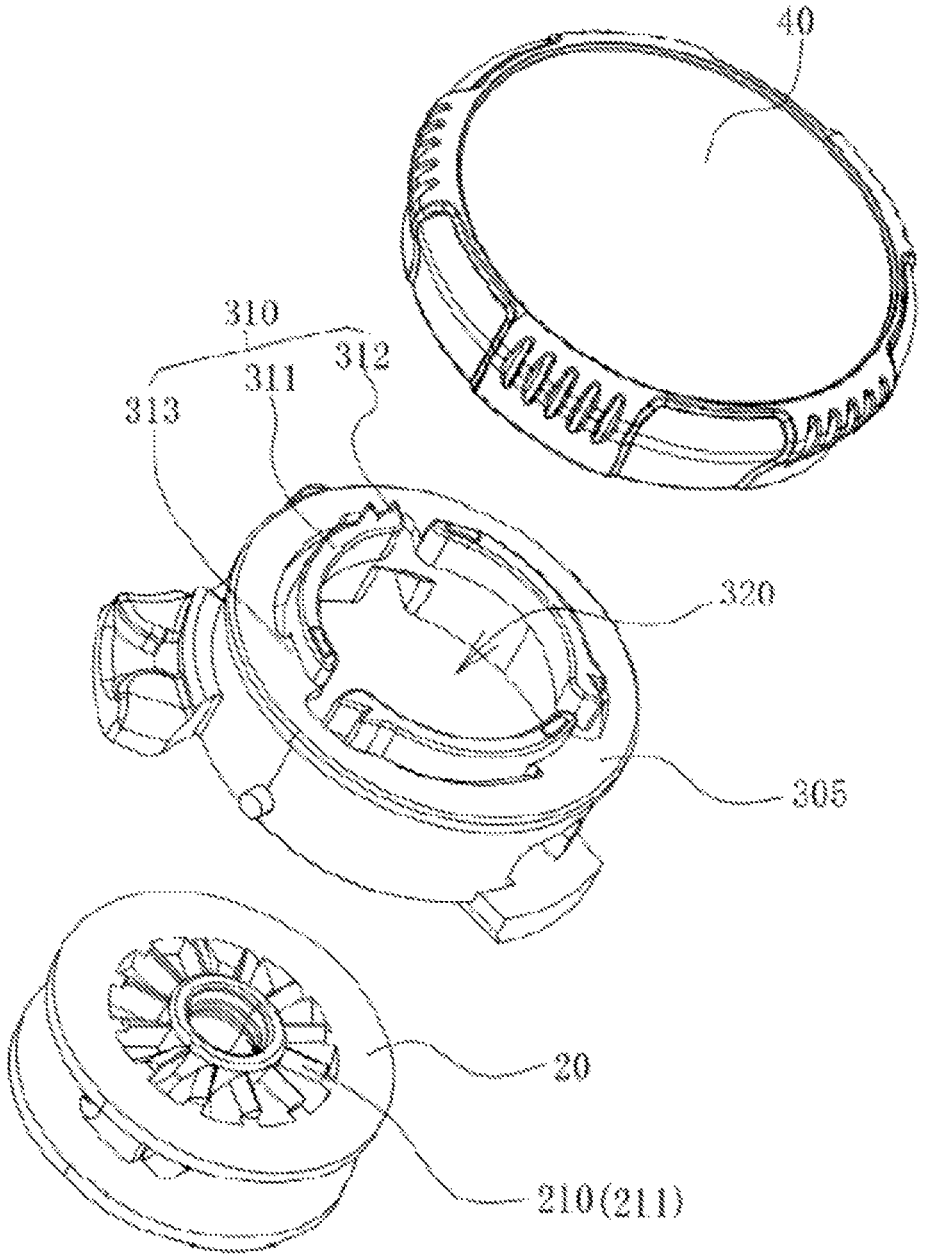
FIG. 6 is an exploded view of the rotation-stopping tray, the rope reel and the rotatable cover of the rope adjustor provided in the second embodiment of the present disclosure.
Figure 8:
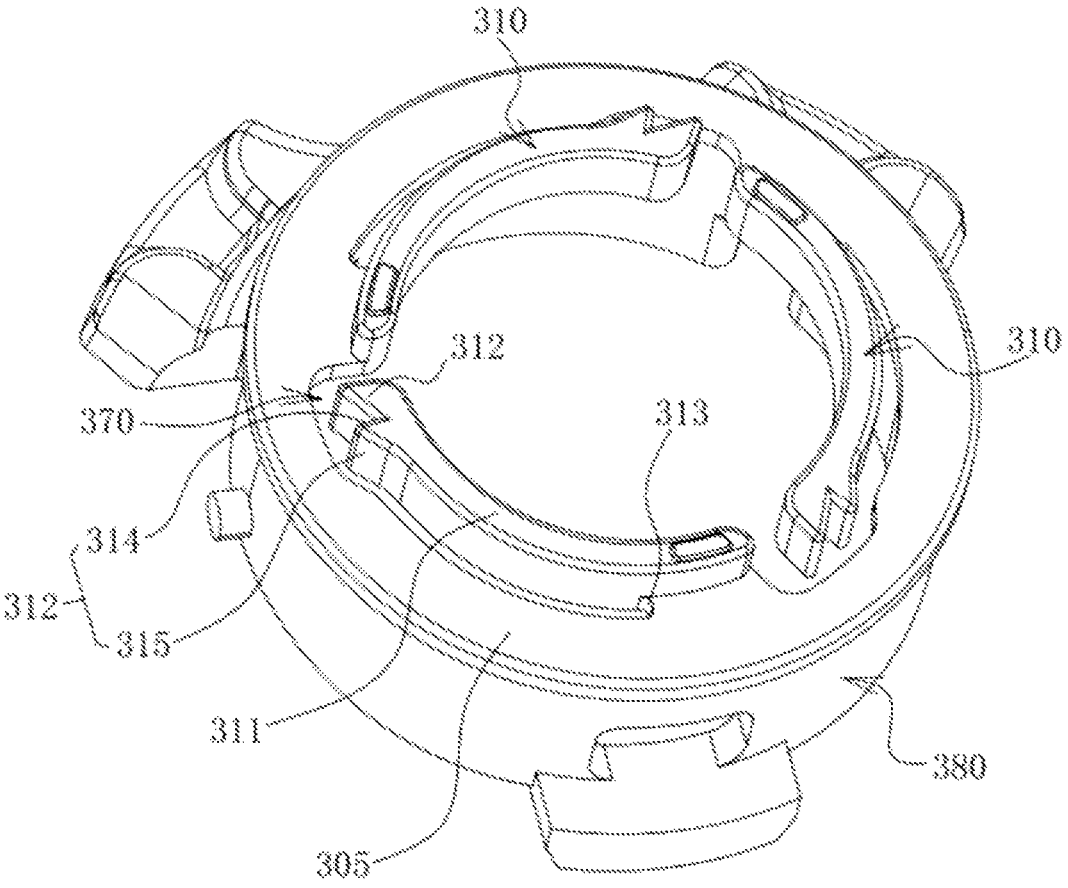
FIG. 8 is a schematic diagram of the rotation-stopping tray provided in the second embodiment of the present disclosure.

As shown in FIGS. 6 and 8, the first rotation-stopping portion 310 provided in the present embodiment comprises a connecting plate 313, a rotation-stopping arm 311, and a first rotation-stopping tooth 312. The first rotation-stopping portion 310 is integrally formed with the tray body 305, so that the connecting plate 313 is fixedly connected to an inner wall of the through cavity 320 and extends a predetermined distance towards an inner side. One end of the rotation-stopping arm 311 is connected on the connecting plate 313 and has a space with the inner wall of the through cavity 320; the connecting plate 313 extends the small predetermined distance towards the inner side, so as to make a small distance between the rotation-stopping arm 311 and the inner wall of the through cavity 320. A shape of the rotation-stopping arm 311 may be an arc, and a radian of the arc matches a shape of the inner wall of the through cavity 320. The first rotation-stopping tooth 312 is connected to another end of the rotation-stopping arm 311 and is movably arranged in the through cavity 320, by suspending the another end of the rotation-stopping arm 311, the first rotation-stopping tooth 312 can move. As shown in FIGS. 5, 7, 8, and 9, the first rotation-stopping tooth 312 abuts against the second rotation-stopping portion 420 to make the rotatable cover 40 to drive the rope reel 20 to rotate in a unidirectional direction. In on embodiment, to improve a stability of limiting, two or one or more than two first rotation-stopping tooth 312 may be set. When the rotatable cover 40 rotates in a forward direction, the rotatable cover 40 drives the second rotation-stopping portion 420 to rotate in a forward direction; the second rotation-stopping portion 420 can press the first rotation-stopping tooth 312 along an inclined-surface contour 315 of the first rotation-stopping tooth 312, making the rotation-stopping arm 311 deform for setting aside a space, so that the second rotation-stopping portion 420 can pass through the first rotation-stopping tooth 312 in a forward direction to achieve a forward rotation. When the rotatable cover 40 shows a tendency to reverse under a tightening force of the rope, due to an abutment of a straight-surface contour 314 of the first rotation-stopping tooth 312, the second rotation-stopping portion 420 cannot slide and is limited, thus the second rotation-stopping portion 420 cannot rotate reversely. The space between the inner wall of the through cavity 320 and the one end of the rotation-stopping arm 311 can provide a activity space for the rotation-stopping arm 311 to move, and a structure of the space and the through cavity 320 is straightforward which facilitates molding during a molding process. It is easy to imagine that the first rotation-stopping portion 310 may also be a pawl structure, and the second rotation-stopping portion 420 may be a ratchet wheel structure, a unidirectional rotation of the rotatable cover 40 can also be achieved by utilizing a unidirectional moveability of the pawl structure and the ratchet wheel structure.

As shown in FIGS. 6 and 8, a keep-space groove 370 is provided on an inner wall of the through cavity 320 in the present embodiment, and the first rotation-stopping tooth 312 is movable located in the keep-space groove 370. The keep-space groove 370 extends to a predetermined depth towards outside, thereby providing a space set aside for the first rotation-stopping tooth 312 to make the first rotation-stopping tooth 312 have a moveable space during a limiting process.

As shown in FIGS. 5, 6, and 8, a lower surface of the rotation-stopping arm 311 in the present embodiment abuts against an upper surface of the rope reel 20. By supporting a lower part of the rotation-stopping arm 311 through the rope reel 20, and when the first rotation-stopping portion 310 limits the second rotation-stopping portion 420, and under a situation that a tightening force of the rope reel 20 is relatively high, a pressing force of the second rotation-stopping portion 420 on the first rotation-stopping portion 310 also increases. During a pressing process on the first rotation-stopping portion 310, the rotation-stopping arm 311 is easy to deform; at this time an upper surface of the rope reel 20 abuts against the rotation-stopping arm 311 to avoid a downward deformation of the rotation-stopping arm 311 make the rotation-stopping arm 311 set aside a space, if the rotation-stopping arm 311 setting aside the space occurs, the second rotation-stopping portion 420 separates from the first rotation-stopping tooth 312, resulting in a failure of a unidirectional rotation function. The upper surface of the rope reel 20 stably supports the rotation-stopping arm 311, avoiding the failure of the unidirectional rotation function and improving a structural stability.

An upper surface of the rotation-stopping arm 311 protrudes from an upper surface of the tray body 305 in the present embodiment, and a protrusion height thereof may be 2.5 mm. A thickness of the whole rotation-stopping arm 311 may range from 2.5 to 2.8 mm Limiting the protrusion height below 2.5 mm, such as 2.25 mm, can ensure a structural stability while reducing the thickness as much as possible. If a thickness of the rotation-stopping arm 311 in the prior art is 2.5 mm, it needs to be raised by 1 mm on the upper surface of the tray body 305, and an additional bearing baffle needs to be mounted on the tray body 305 with a height of 4 mm. Compared with the prior art that the additional bearing baffle needs to be set on the tray body 305 with the height of 4 mm, the protrusion height from the upper surface of the tray body 305 in the present technical solution is up to 2.5 mm (or even only 2.25 mm), greatly reducing a thickness of the whole device. It should be noted that the present structure meets different size requirements for different needs, and the above-mentioned size is only used as a specific application of a specification.

As shown in FIGS. 6 and 8, in the present embodiment there are three first rotation-stopping portions 310, the three first rotation-stopping portions 310 are arranged in a circular array around a central axis of the through cavity 320. The three first rotation-stopping portions 310 are uniformly distributed in a circumferential direction, and the three first rotation-stopping portions 310 simultaneously act on the rotatable cover 40, thereby increasing limit points, and three limit points are uniformly distributed, thereby improving a stability of the first rotation-stopping portion 310 for unidirectional limiting. It is easy to imagine that the first rotation-stopping portion 310 may also be set to 1, 2, or more than 3, and can also achieve a function of a unidirectional rotation and a limit.

Figure 9:
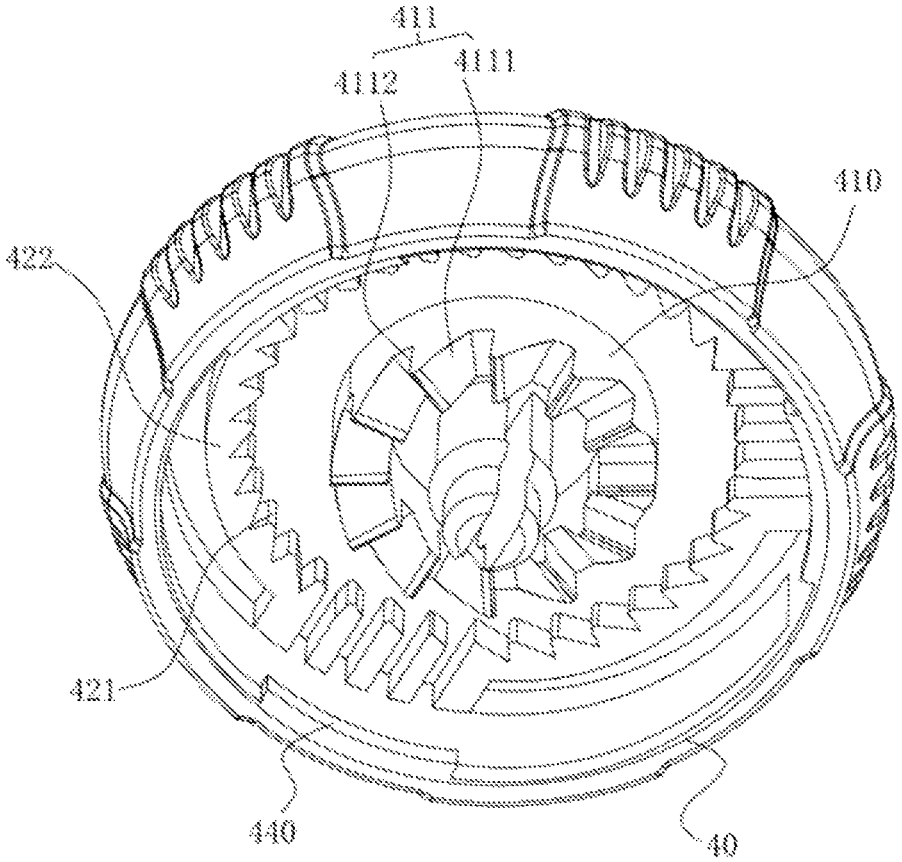
FIG. 9 is a schematic diagram of the rotatable cover provided in the second embodiment of the present disclosure.
Figure 10:
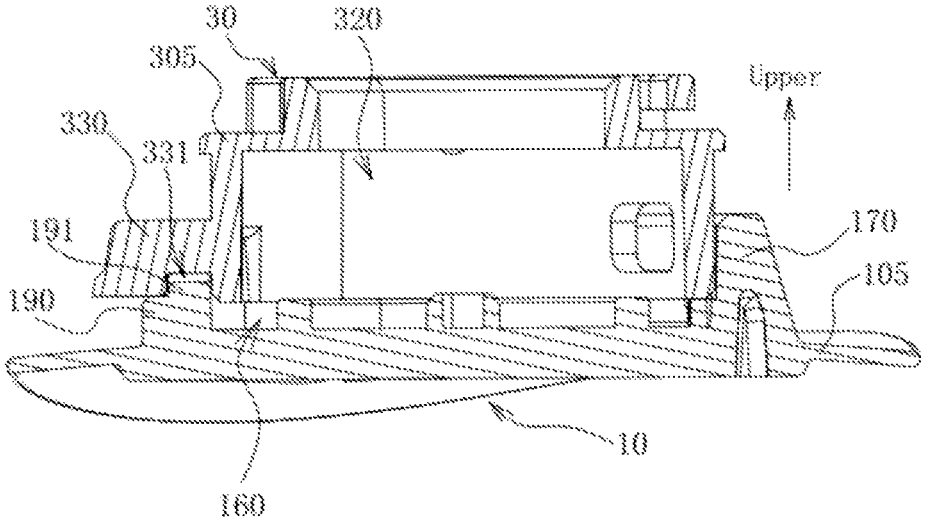
FIG. 10 is a cross-sectional view of a base and a rotation-stopping tray of a rope adjustor provided in a third embodiment of the present disclosure.

As shown in FIGS. 5, 7, and 9, the second rotation-stopping portion 420 in the present embodiment comprises a first gear ring 422, the first gear ring 422 is arranged around the rotatable cover 40. The first gear ring 422 has a second rotation-stopping tooth 421, the second rotation-stopping tooth 421 matches with the first rotation-stopping tooth 312. The first gear ring 422, the second rotation-stopping tooth 421, and the rotatable cover 40 are integrally formed. The second rotation-stopping tooth 421 is arranged on an inner side of the first gear ring 422. When the rotatable cover 40 is in a connecting state with the rotation-stopping tray 30, the first rotation-stopping tooth 312 of the first rotation-stopping portion 310 is located on the inner side of the first gear ring 422 to make the second rotation-stopping tooth 421 engage with the first rotation-stopping tooth 312.

To facilitate production of the rotatable cover 40, the first gear ring 422 is arranged in a non-complete gear ring setting. As shown in FIG. 7, the first gear ring 422 is divided into a plurality of arc segments, and the plurality of arc segments are set with intervals, there are spaces between the plurality of arc segments and spaces between the arc segments and the inner wall of the rotatable cover 40. A plurality of independent gear platforms are set in the space between the plurality of arc segments, and one end of the independent gear platform facing inward is a unidirectional gear, and one end of the independent gear platform facing outward is connected to the inner wall of the rotatable cover 40. Through a cooperation between a unidirectional tooth of the arc segment and the unidirectional tooth of the independent gear platform, one complete first gear ring 422 is formed, which facilitates mold design and production, otherwise it is difficult for the mold to form the rotatable cover 40.

As shown in FIGS. 5, 7, and 9, the rotatable cover 40 in the present embodiment is further arranged with a second linkage portion 410, the second linkage portion 410 is located on an inner side of the first gear ring 422, the second linkage portion 410 is arranged with a second linkage tooth 411, the second linkage tooth 411 is used for connecting with the rope reel 20. The second linkage tooth 411 is located on a lower surface of the second linkage portion 410, when the rotatable cover 40 is in a connecting state with the rope reel 20, the second linkage tooth 411 is connected to the first linkage tooth 211 on the rope reel 20, thereby driving the rope reel 20 to rotate through a drive from the rotatable cover 40. The second linkage tooth 411 has a vertical surface 4112 set along an up-to-down direction, and an inclined surface 4111 at a predetermined angle the up-to-down direction. In this way, during connecting, the vertical surface 4112 on the first linkage tooth 211 abuts against the vertical surface 4112 on the second linkage tooth 411. When rotating the rotatable cover 40, the second linkage tooth 411 is not easily separated from the first linkage tooth 211, ensuring a stability of the rotatable cover 40 in driving the rope reel 20.

As shown in FIGS. 5, 7, and 9, an inner wall of the rotatable cover 40 in the present embodiment is arranged with a limit bump 440, the limit bump 440 extends a distance towards inner side. A snap-fitting slot 380 is arranged on an outer wall of the tray body 305, the snap-fitting slot 380 extends a preset distance towards inner side. The limit bump 440 is connected in the snap-fitting slot 380 and can move with an up-to-down direction in the snap-fitting slot 380 to make the rotatable cover 40 be connected or separated from the rope reel 20, ensuring that when the rotatable cover 40 moves, the rotatable cover 40 will not be completely separated from the rotation-stopping tray 30; and when the rotatable cover 40 moves downwards, the rotatable cover 40 can connect with the rotation-stopping tray 30 and the rope reel 20; after the rotatable cover 40 is pulled upwards, the rotatable cover 40 is separated from the rotation-stopping tray 30 and the rope reel 20.

Embodiment 3

As shown in FIGS. 2, 10, 11, and 14, an accommodating cavity 160 is set on the base 10 for connecting to the rotation-stopping tray 30 in a fitting snap. A through cavity 320 is arranged in the rotation-stopping tray 30 for mounting the rope reel 20. When the rotatable cover 40 is pressed down, the rotatable cover 40 can connect with the rope reel 20 and the rotation-stopping tray 30. The rotatable cover 40 rotates to drive the rope reel 20 to rotate, and the rope reel 20 is connected with a rope that needs to be tightened, and the rope is tightened by a rotation of the rope reel 20, thereby achieving a tightening function. To prevent loosening, the rotatable cover 40 is activated by the rotation-stopping tray 30, so that the rotatable cover 40 drives the rope reel 20 to only rotate unidirectionally in a reeling direction during a reeling process. When loosening the rope, the rotatable cover 40 is pulling upwards to separate the rotatable cover 40 from the rotation-stopping tray 30. The rotation-stopping tray 30 releases a unidirectional limit on the rotatable cover 40, and both the rotatable cover and the rope reel 20 can rotate in reverse to loosen the rope.

Figure 12:
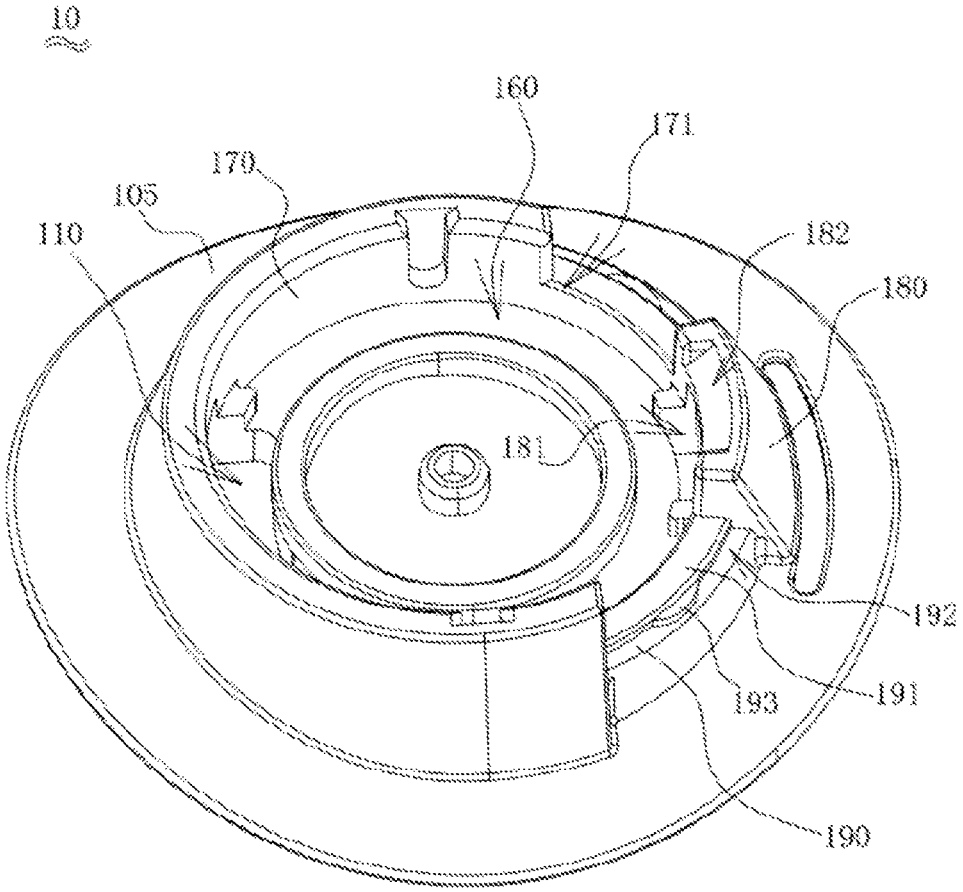
FIG. 12 is a schematic diagram of the base of the rope adjustor provided in the third embodiment of the present disclosure.

As shown in FIGS. 11, 12, and 13, for a convenience of a structural description, a structure of the rope adjustor is set to be cylindrical, and an up-to-down direction is an axial direction of the rope adjustor, a direction towards the axis is inward, and a direction deviated from the axis is outward. In the present embodiment, the base 10 comprises a base tray 105. The base tray 105 is in a sheet shape, and is circular in some embodiments, facilitating connecting the base tray 105 to a fabric product. An arc-shaped baffle 170 and a blocking bump 180 set with intervals with the arc-shaped baffle 170 are arranged on the base tray 105. The arc-shaped baffle 170 and the blocking bump 180 form the above-mentioned accommodating cavity 160, and a limit notch 171 is formed between the blocking bump 180 and the arc-shaped baffle 170. In the present embodiment, two limit notches 171 can be set, which are the first limit notch 120 and the second limit notch 130 respectively, the limit notch 171 is used to snap and fit a threading portion on an outer wall of the rotation-stopping tray 30, wherein a connecting boss 190 is arranged in the limit notch 171. Two ends of the connecting boss 190 are respectively connected to the arc-shaped baffle 170 and the blocking bump 180. An upper boss 191 is arranged on the connecting boss 190, and two ends of the upper boss 191 are also connected to the arc-shaped baffle 170 and the blocking bump 180 respectively; a width dimension of the upper boss 191 is smaller than a width dimension of the connecting boss 190, thereby forming a limit step 192 between the upper boss 191 and the connecting boss 190. The rotation-stopping tray 30 comprises a tray body 305, and a plurality of threading portions arranged on the outer wall of the tray body 305, such as the first threading portion 330 and the second threading portion 340. Taking the first threading portion 330 as an example, when the rotation-stopping tray is connected to the base tray 105, the first threading portion 330 is arranged inside the limit notch 171 and on the connecting boss 190. One side of the first threading portion 330 facing the connecting boss 190 is provided with a first keep-space groove 331, and the first keep-space groove 331 is sleeved on the upper boss 191. By cooperating the first threading portion 330 with the upper boss 191 through the first keep-space groove 331, the rotation-stopping tray 30 can be lowered for connecting, thereby reducing a height of the rotation-stopping tray 30 and reducing a thickness of the whole present tying device.

In the present embodiment, setting an arc-shaped baffle 170 on the base tray 105 and enclosing the arc-shaped baffle 170 and the blocking bump 180 to form an accommodating cavity 160, the accommodating cavity 160 is used for mounting the rotation-stopping tray 30 and forming a limit notch 171 between the arc-shaped baffle 170 and the blocking bump 180. The limit notch 171 can be snapped and fitted into the plurality of threading portions of the rotation-stopping tray 30 (such as the first threading portion 330 or the second threading portion 340), thereby limiting the rotation-stopping tray 30 to make a connection between the rotation-stopping tray 30 and the base tray 105 more stable. By setting a connecting boss 190 and an upper boss 191 inside the limit notch 171, the blocking bump 180 on two sides of the limit notch 171 is connected to the arc-shaped baffle 170 through two ends of the connecting boss 190 and the upper boss 191, thereby increasing a thickness of the base tray 105 at a position of the limit notch 171, thus strengthening a structure of the base tray 105 at the position of the limit notch 171. An effect of the connecting boss 190 and the upper boss 191 are equivalent to a connecting effect of reinforcing ribs, making the blocking bump 180 and the arc-shaped baffle 170 on two sides not easily deformed under force; in a high-temperature setting process and a low-temperature setting process of production process of products, the base tray 105 is not easily deformed under force due to the connecting effect of the reinforcing ribs. Moreover, a connecting boss 190 has a preset height that can block fabric, making it difficult for the fabric to enter the limit notch 171 and affecting subsequent assembly. Moreover, by cooperating the first threading portion 331 with the upper boss 191, a height of the rotation-stopping tray 30 can be reduced, and a thickness of the whole present tying device can be reduced; mounting a thinner tying device on wearable item, such as shoes, is more practical and convenient.

As shown in FIGS. 11 and 12, further, a reinforcing lug 193 is arranged on the upper surface of the connecting boss 190, the reinforcing lug 193 is connected to the upper boss 191. The connecting boss 190 is in an arc shape; by setting the reinforcing lug 193, a connection between the connecting boss 190 and the upper boss 191 is more stable, thereby further firming a connection between the blocking bump 180 on two sides and the arc-shaped baffle 170. Since the blocking bump 180 and the arc-shaped baffle 170 do not move relative to each other, the whole base tray 105 will be constrained and not easily deformed. The reinforcing lug 193 is in an arched shape or a semicircular shape, which can have a bigger contact surface between the reinforcing lug 193 to the connecting boss 190, making a more stable structure.

If an thickness of assembly needs to be reduced, a height of the upper boss 191 needs to be higher, which can make the rotation-stopping tray 30 lowered downwards more; however, the upper boss 191 and the connecting boss 190 are a part of a reinforced structure, and if the height of the upper boss 191 is higher, a thickness of the connecting boss 190 is smaller, thereby a connection strength cannot be guaranteed. Therefore lowering a connection structure downwards 0.6-1 mm to form the upper boss 191, which can ensure a structural strength under a situation that reducing a thickness of the present device is ensured. In one embodiment, the height of the upper boss 191 is 0.65 mm. It is easy to imagine that other heights of the upper boss 191 can also be adopted, such as those larger than 1 mm There are different heights of the upper boss 191 for different shoes, which can meet requirements of being higher than the prior fabric.

Furthermore, in the present embodiment, the base tray 105, the blocking bump 180, the arc-shaped baffle 170, the connecting boss 190, the upper boss 191, and the reinforcing lug 193 are integrally formed. Thus, a whole structure of the base tray 105 is formed through injection molding, with fast molding speed, mature technology, and reduced production costs.

As shown in FIGS. 11, 12, and 13, further, in the present embodiment, in order to achieve a connection between the rotation-stopping tray 30 and the base tray 105, a snap-fitting piece 350 on a circumference of an outer wall of the tray body 305 of the rotation-stopping tray 30 is set as a snap-fitting platform, and another snap-fitting piece 350 on the circumference of the outer wall of the tray body 305 is set as a snap-fitting hook portion 351. The snap-fitting platform and the snap-fitting hook portion 351 may be set oppositely. A snap-fitting groove 181 is arranged on an inner wall of one side of the blocking bump 180 facing the accommodating cavity 160, and a snap-fitting position 110 is arranged on an inner wall of one side of the arc-shaped baffle 170 facing the accommodating cavity 160, and the snap-fitting position 110 and the snap-fitting groove 181 are set oppositely. When mounting the rotation-stopping tray 30 with the base tray 105, first inserting the snap-fitting platform into the snap-fitting position 110 to achieve a limit for one side, then pressing the rotation-stopping tray 30 so that the snap-fitting hook portion 351 deforms and sets aside a space for not limiting, and then the snap-fitting hook portion 351 enters an inner side of the accommodating cavity 160, and then the snap-fitting hook portion 351 is snapped and fitted into the snap-fitting groove 181 to achieve a fixation. Thus, the tray body 305 is embedded in the accommodating cavity 160, and the snap-fitting hook portion 351 is snapped and fitted in the snap-fitting groove 181. By adopting a cooperation of the snap-fitting hook portion 351 and the snap-fitting groove 181, assembly can be achieved by simply pressing, achieving a rapid assembly of the rotation-stopping tray 30 and the base tray 105, and improving assembly efficiency.

As shown in FIGS. 11, 12, and 13, further, the snap-fitting hook portion 351 in the present embodiment comprises a snap-fitting hook 352, the snap-fitting hook 352 protrudes outward. A slot 306 is arranged between the tray body 305 and two sides of the snap-fitting hook 352. By setting the slot 306, two circumferential sides of the snap-fitting hook 352 are not connected to the tray body 305, so that the snap-fitting hook portion 351 has greater elasticity without a limit from an outer wall of the tray body 305, preventing the snap-fitting hook portion 351 from getting too tight and making assembly more convenient.

As shown in FIGS. 11, 12, and 13, further, an inner wall of the snap-fitting hook portion 351 in the present embodiment is provided with a second keep-space groove 353 (as shown in FIG. 13). The second keep-space groove 353 is located on one side facing the accommodating cavity 160. It is necessary to mount the rope reel 20 inside the rotation-stopping tray 30, and if the second keep-space groove 353 is not set, when the snap-fitting hook portion 351 needs to move inward during a process that the snap-fitting hook portion 351 is being pressed, there is no space for the snap-fitting hook portion 351 to move due to a block from the rope reel 20, making it difficult for the snap-fitting hook portion 351 to be assembled. Therefore, through the second keep-space groove 353, a thickness of the snap-fitting hook portion 35 can be reduced so as to have a greater elasticity. And if the snap-fitting hook portion 351 is too long, the nap-fitting second keep-space groove 353 can prevent a deformation of the snap-fitting hook portion 351 caused by the snap-fitting hook portion 351 and the rope reel 20 sticking together during assembly, thereby reducing assembly difficulty and improving assembly efficiency.

As shown in FIG. 12, further, in the present embodiment, a guide groove 182 is provided at an inner edge of an upper surface of the blocking bump 180. The guide groove 182 has an inclined surface extending from top to bottom and facing inward, and the snap-fitting hook portion 351 moves into the snap-fitting groove 181 through a guidance of the inclined surface. During an assembly of the rotation-stopping tray 30 and the base tray 105, the snap-fitting hook portion 351 first contacts the guide groove 182, and then presses the snap-fitting hook portion 351 through a guidance of the guide groove 182 to make the snap-fitting hook portion 351 move towards inner and lower sides, so as to guide the snap-fitting hook portion 351 into the accommodating cavity 160, and then the snap-fitting hook portion 351 continues to press downwards to be snapped and fitted into the snap-fitting groove 181, improving assembly accuracy and efficiency.

Embodiment 4

The present embodiment also provides a wearable item, comprising the above-mentioned rope adjustor. As the rope adjustor has been described above, it will not be repeated here.

Embodiment 5

Please refer to FIG. 5. The present embodiment provides an regulating method based on a rope adjustor, and the regulating method is applied to the above-mentioned rope adjustor. The regulating method comprises:

S100: Based on a regulating target, determining an adjusting way of a rotatable cover 40 in the rope adjustor, the regulating target comprises tightening the rope or loosening the rope;

S200: Controlling the rotatable cover 40 to move to a target position according to the adjusting way of the rotatable cover 40, in order to achieve regulating the rope.

In one embodiment, please refer to FIG. 6. Steps that when the regulating target is lightening the rope, controlling the rotatable cover 40 to move to a target position according to the adjusting way to achieve regulating the rope, comprise:

S301: Controlling the rotatable cover 40 to rotate directly;

S302: Controlling the rotatable cover 40 to rotate with the rope reel 20 through a cooperation of a first linkage portion 210 and a second linkage portion 410, so as to achieve tightening the rope;

S303: Controlling the rotatable cover 40, through a cooperation of the first rotation-stopping portion and the second rotation-stopping portion, to limit the tightened rope.

In one embodiment, please refer to FIG. 6. Steps that when the regulating target is loosening the rope, controlling the rotatable cover 40 to move to a target position according to the adjusting way to achieve regulating the rope, comprise:

S311: Controlling the rotatable cover 40 to be pulled upwards;

S312: Directly pulling the rope that threads through wearable item, so as to achieve loosening the rope;

S313: Controlling the rotatable cover 40 to be pressed downwards, and controlling the rotatable cover 40 through a cooperation of the first rotation-stopping portion and the second rotation-stopping portion, to limit the loosened rope.

The above are only some preferred embodiments of the present disclosure and are not intended to limit the present disclosure. Any modifications, equivalent substitutions, and improvements made within the spirit and principles of the present disclosure shall be included in the protection scope of the present disclosure.

What is claimed is:

1. A rope adjustor, comprising:

a base;

a rope reel with a first linkage portion arranged on the rope reel;

a rotation-stopping tray, the rotation-stopping tray is arranged on and connected to the base, and the rope reel is arranged inside the rotation-stopping tray, and a first rotation-stopping portion is arranged on one side of the rotation-stopping tray away from the base; and a rotatable cover, the rotatable cover is arranged on and rotationally connected to the rotation-stopping tray, and the rotatable cover is insertably connected to the rope reel, and one side of the rotatable cover facing the rotation-stopping tray is provided with a second linkage portion and a second rotation-stopping portion, and the first linkage portion is cooperated with the second linkage portion, and the first rotation-stopping portion is cooperated with the second rotation-stopping portion;

wherein the first linkage portion comprises a plurality of first linkage teeth, and the plurality of first linkage teeth are set with intervals and form a circle;

the second linkage portion comprises a plurality of second linkage teeth, and the plurality of second linkage teeth are set with intervals and form a circle; and the plurality of first linkage teeth and the plurality of second linkage teeth are intermeshed.

2. The rope adjustor according to claim 1, wherein the first rotation-stopping portion comprises at least one rotation-stopping arm, and one end of the rotation-stopping arm is connected to the rotation-stopping tray, and another end of the rotation-stopping arm is a free end, and at least one first rotation-stopping tooth is arranged on the rotation-stopping arm; and the second rotation-stopping portion comprises a plurality of second rotation-stopping teeth, and the plurality of second rotation-stopping teeth are set with intervals and form a circle, and the first rotation-stopping tooth and the second rotation-stopping tooth are intermeshed.

3. The rope adjustor according to claim 2, wherein a space is provided between the rotation-stooping portion and an upper surface of a tray body of the rotation-stopping tray, and an abutment boss is arranged on the upper surface of the tray body of the rotation-stopping tray, and the abutment boss corresponds to a free end of the first rotation-stopping portion.

4. The rope adjustor according to claim 1, wherein a through cavity is arranged on the rotation-stopping tray, and the rope reel is set in the through cavity and is limited through the through cavity, an inserting-and-connecting hole is arranged on the rope reel, and one side of the rotatable cover facing the rotation stopping tray is provided with an inserting-and-connecting column, and the inserting-and-connecting column is fixedly connected to the rotatable cover, and the inserting-and-connecting column is insertably connected to the inserting-and-connecting hole through the through cavity.

5. The rope adjustor according to claim 4, wherein the inserting-and-connecting column comprises, a first connecting column, a free end of the first connecting column away from the rotatable cover is provided with a first limit convex portion that protrudes outwards; and a second connecting column, a free end of the second connecting column away from the rotatable cover is provided with a second limit convex portion that protrudes outwards;

the first connecting column and the second connecting column are set with intervals; and an inner part of the inserting-and-connecting hole is provided with a limit concave portion that concaves inwards, and both the first limit convex portion and the second limit convex portion are cooperated with the limit concave portion for a limit.

6. The rope adjustor according to claim 1, wherein the base comprises a first connecting tray, and an edge of the first connecting tray is provided with a first connecting hole; or the base comprises a second connecting tray, and an edge of the second connecting tray is provided with a second connecting hole, and a gap is arranged on the second connecting tray.

7. The rope adjustor according to claim 1, wherein the base comprises a base tray, an arc-shaped baffle and a blocking bump set with intervals with the arc-shaped baffle is arranged on the base tray, an accommodating cavity is enclosed by the arc-shaped baffle and the blocking bump, and a limit notch is formed between the blocking bump and the arc-shaped baffle, and a connecting boss is arranged inside the limit notch, and two ends of the connecting boss are respectively connected to the arc-shaped baffle and the blocking bump, and an upper boss is arranged on the connecting boss; and the rotation-stopping tray comprises a threading portion, and the threading portion is arranged inside the limit notch and located on the connecting boss; and one side of the threading portion facing the connecting boss is provided with a first keep-space groove, and the first keep-space groove is sleeved on the upper boss.

8. The rope adjustor according to claim 7, wherein a snap-fitting groove is arranged on an inner wall of the blocking bump facing the accommodating cavity; and the rotation-stopping tray comprises a tray body and a snap-fitting hook portion arranged on an outer wall of the tray body, the tray body is embedded in the accommodating cavity, and the snap-fitting hook portion is snapped and fitted in the snap-fitting groove.

9. The rope adjustor according to claim 8, wherein the snap-fitting hook portion comprises a snap-fitting hook, and slots are arranged between either side of the snap-fitting hook and the tray body.

10. The rope adjustor according to claim 6, wherein an inner wall of the snap-fitting hook portion is provided with a second keep-space groove.

11. The rope adjustor according to claim 8, wherein an inner edge of an upper surface of the blocking bump is provided with a guide groove, and the guide groove has an inclined surface extending inward from top to bottom; and the snap-fitting hook portion moves into the snap-fitting groove through a guidance of the inclined surface.

12. The rope adjustor according to claim 1, wherein a second rotation-stopping portion is arranged inside the rotatable cover;

the rotation-stopping tray comprises: a tray body, a through cavity is arranged in the tray body and the rope reel is rotatably arranged in the through cavity, a first rotation-stopping portion, one end of the first rotation-stopping portion is connected to an inner wall of the through cavity, and another end of the first rotation-stopping portion is movably located in the through cavity; and the another end of the first rotation-stopping portion is used to connect and cooperate with the second rotation-stopping portion to make the rotatable cover drive the rope reel to rotate in a unidirectional direction.

13. The rope adjustor according to claim 12, wherein the first rotation-stopping portion comprises: a connecting plate connected to the inner wall of the through cavity and extended inward a predetermined distance, a rotation-stopping arm, one end of the rotation-stopping arm is connected to the connecting plate and has a space from the inner wall of the through cavity, and a first rotation-stopping tooth connected to anther end of the rotation-stopping arm and movably located in the through cavity; and the first rotation-stopping tooth abuts against the second rotation-stopping portion to make the rotatable cover drive the rope reel to rotate in the unidirectional direction.

14. The rope adjustor according to claim 13, wherein a keep-space groove is provided on the inner wall of the through cavity, and the first rotation-stopping tooth is movably located in the keep-space groove.

15. A wearable item, comprising the rope adjustor according to claim 1.

* * * * *